United States Patent [19]

Wellman

[11] 4,007,650

[45] Feb. 15, 1977

[54] GARDEN HOSE COUPLING TOOL

[75] Inventor: Lester R. Wellman, Highland Park, Ill.

[73] Assignee: Barbara F. Wellman, Highland Park, Ill.

[22] Filed: Nov. 12, 1975

[21] Appl. No.: 631,411

[52] U.S. Cl. ..... 81/64; 285/38

[51] Int. Cl.[2] ..... B25B 13/52

[58] Field of Search ..... 285/38, 39; 24/279; 81/64, 3.43

[56] References Cited

UNITED STATES PATENTS

| | | | |
|---|---|---|---|
| 864,103 | 8/1907 | Mulroyan | 81/64 X |
| 1,061,904 | 5/1913 | Finsel | 81/3.43 X |
| 1,235,657 | 8/1917 | Coles | 285/38 X |
| 1,953,238 | 4/1934 | Kosanovich | 81/3.43 |
| 2,733,937 | 2/1956 | Mowrer | 285/39 |
| 3,231,955 | 2/1966 | Taylor | 285/38 X |
| 3,422,469 | 1/1969 | Tunstall et al. | 81/3.43 X |

FOREIGN PATENTS OR APPLICATIONS

| | | | |
|---|---|---|---|
| 1,027,021 | 3/1958 | Germany | 285/38 |

*Primary Examiner*—Thomas F. Callaghan
*Attorney, Agent, or Firm*—Robert W. Erickson

[57] ABSTRACT

A handle having a pair of elongated arms and a band-like ring portion adapted to encircle and engage a female hose coupling. The handle functions as a permanently attached wrench to facilitate connecting a section of hose to the threaded end of a spigot or faucet, or one section of hose to another, or to a sprinkler, nozzle or other device. Preferably, the handle comprises a unitary body consisting of a pair of arms and the band-like ring, and means for providing a wrapping force of the ring around the hose coupling.

2 Claims, 3 Drawing Figures

GARDEN HOSE COUPLING TOOL

APPLICABILITY OF INVENTION

As described herein, the present invention encompasses a wrench-like handle adapted to firmly engage the female coupling found at the end, or ends of a common hose. Such female couplings are utilized primarily to connect the hose to a water supply or to another section of hose. The handle has a pair of elongated arms, one end of each being integral with a flat portion which forms a band-like ring having a nominal inside diameter approximating the outside diameter of the female coupling. Means which provides a wrapping force of the ring around the female coupling, is disposed proximate to the shoulder junction of the ends of the arms with the ring-forming flat portion of the handle body.

Although the handle may be removed from the coupling after the latter has engaged the threaded male end of the water supply, it is intended that it remain permanently attached thereto. Thus, the need for pliers, pipe wrenches, etc., each time the hose is to be connected or disconnected is eliminated. The engagement of the handle and the female coupling is easily accomplished, and may be effected by the manufacturer of the hose. On the other hand, the coupling and handle, or the handle itself may be marketed as a kit, to be attached to the hose by the ultimate user.

OBJECTS AND EMBODIMENTS

A principal object of my invention is to provide a handle which facilitates the attachment of a female hose coupling to a water supply, or the connection of one section of hose to another, or attachment to any other device having a threaded male coupling. A corollary objective is to afford a hose coupling handle which is inexpensive, sturdy, easily manufactured and which can be permanently attached to the hose coupling.

Another object of the present invention is directed toward a hose coupling handle having a unitary body portion. These objects, as well as others which will become dent from the description hereinafter set forth, are achieved by providing a hose coupling handle which comprises, in combination: (a) a body having a pair of elongated arms, one end of each being integral with a flat portion forming a band-like ring; and, (b) means providing a wrapping force of said ring around said coupling, and disposed proximate to the junction of said arms with said flat portion. In a preferred embodiment, the body portion is unitary.

In a specific embodiment, the interior surface of the band-like ring is knurled, the knurls preferably being parallel to the axis of the ring.

These, as well as other objects and embodiments of my invention, will become evident to those skilled in the arm from the following more detailed description thereof.

SUMMARY OF INVENTION

A length of hose is equipped at one end with a threaded male fitting and, at its other end with a freely rotatable female hose coupling. The former is adapted to engage the female coupling on the end of a spray nozzle, or other sprinkling device, while the latter is intended to be attached to the threaded male fitting of a water supply spigot, or of another section of hose. My invention encompasses a wrench-like handle adapted to engage the female hose coupling, whether on the hose itself, or on the nozzle, such that the same may be readily and securely attached to a corresponding threaded male fitting. Compared to wrenches, pliers, etc., the low cost of the present handle allows permanent attachment to the coupling to facilitate subsequent disconnections and connections.

Briefly, the coupling handle comprises a body, preferably unitary in construction, having a pair of elongated arms one end of each being integral with a flat portion which forms a band-like ring. Means providing a wrapping force for the ring around the female coupling is disposed proximate to the shoulder junction of the arms with the flat portion. The band-like ring is wider than the nominal thickness of the arms, and the interior surface is knurled to facilitate gripping the coupling. The knurls may be cross-hatched, radial, or parallel to the axis of the ring; the latter is preferred since such configuration corresponds to the knurled portion of most couplings.

The body of the handle may be fabricated in two halves with the band-like ring portion having connecting means such as opposing "C" hooks, a hook and a hasp, a hook and eye, etc. Preferably, from the standpoint of ease of manufacturing and strength, the body is unitary in construction. The wrapping force is provided by means proximate to the shoulder of the arms and the flat portion, and, further, substantially perpendicular to the horizontal plane containing the axis of the band-like ring. Suitable wrapping force means include rivets, screws, cotter pins, etc., with the preferred means constituting a screw which engages both of the arms. Using a screw is also advantageous in that it enables simple attachment of the handle to the female coupling while providing a relatively immovable point at which the wrapping force is augmented. The arms are U-shaped in cross-section to afford strength and comfort when the handle is used, and preferably are unequal in length. Additionally, the shorter of the two arms is otherwise sized to nest within the longer handle. Thus seated, the risk of separation of the handles is eliminated and the wrapping tendency of the ring is thus maintained.

Any material capable of affording the necessary wrapping force, while simultaneously being semi-rigid, can be employed in fabricating the tool body. Suitable material includes thin-walled metals such as steel and other alloys, polyvinyl, polycarbonate, Delrin, ABS resin, etc. The particular material employed is not essential to the present invention, nor is the method selected for manufacturing, whether stamping, forming, injection molding, or other. A wide variety of materials of construction and methods of manufacture will be evident to those possessing the requisite skill in the appropriate art.

BRIEF DESCRIPTION OF DRAWINGS

The present invention will be further described with reference to the accompanying drawings which serve to illustrate the several embodiments thereof. Briefly.

DETAILED DESCRIPTION OF DRAWINGS

Figure 1:
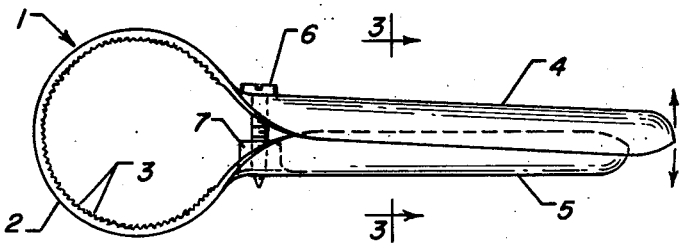
FIG. 1 is a side elevation of the coupling handle generally indicated as 1.

With specific reference now to the several drawings, the hose coupling handle, indicated generally as 1, is shown in side elevation in FIG. 1. As illustrated, the handle body consists of a band-like, substantially circular ring 2, the interior surface of which contains a multiplicity of knurls 3. Integral with the ring is a pair of elongated arms 4 and 5, the latter indicated as being the shorter of the two. In this illustration, the means which provides the wrapping force for ring 2 is shown as a screw 6 which engages both of the arms 4 and 5 at a point proximate to the shoulder junction where the ends thereof flare out and become integral with the ring. It should be noted that screw 6 is substantially perpendicular to the horizontal plane containing the axis of ring 2. Hollow extruded projection 7, integral with the shoulder formed by arm 5 affords additional length for engaging the threads of the lower portion of screw 6 and tightens the ring by pressing arms 4 and 5 together.

Figure 2:
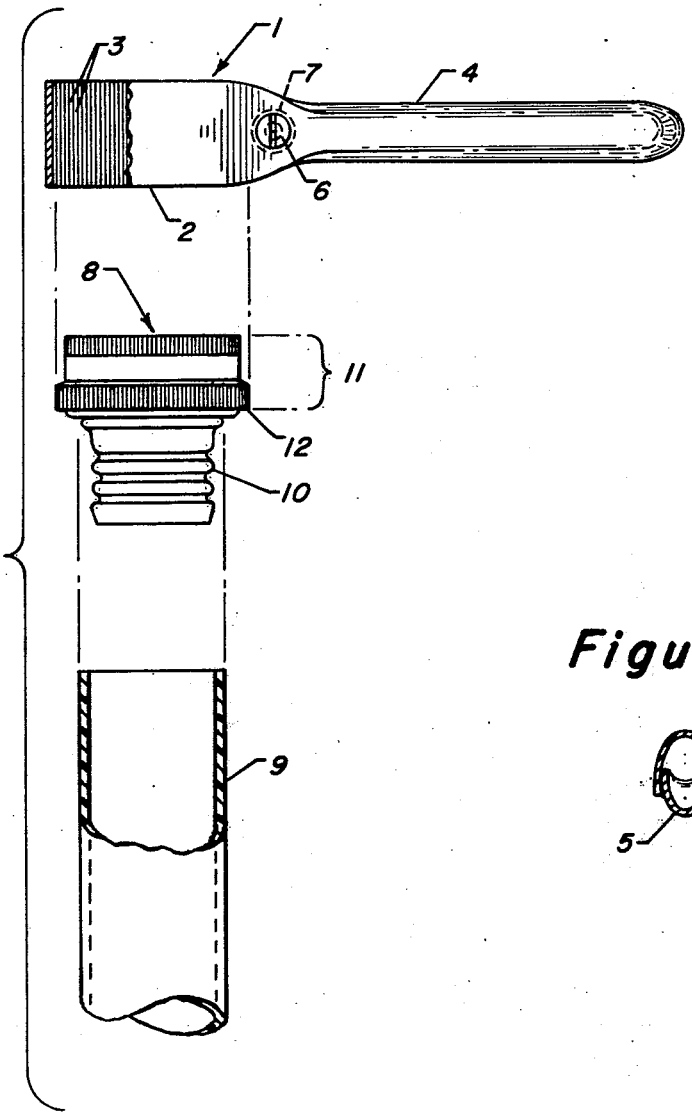
FIG. 2 is an exploded view indicating the relationship of hose section 9, female coupling 8 and handle 1, with the latter shown in a partially broken-away plan view.

FIG. 2 is presented as an exploded view to show the general relationship of hose 9, coupling 8 and the coupling handle 1. The squared end of hose 9 is fitted over the male spur 10 of coupling assembly 8. Rotatable female end 11 is shown in its most common configuration where knurled nut 12 has the largest outside diameter and is that portion of coupling 8 which is encircled and engaged by ring 2. A partially broken-away plan view of handle 1 is presented to illustrate that knurls 3 are parallel to the axis of the ring 3. The location of screw 6, with respect to arms 4 and 5 is shown as being proximate to the junction where the ends of arms 4 and 5 become integral with the flat portion which forms band-like ring 2.

Figure 3:
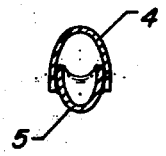
FIG. 3 is a sectional view of the nested arms, and is taken substantially along the line 3—3 of FIG. 1.

FIG. 3 is a sectioned view of U-shaped arms 4 and 5, taken along the line 3—3 of FIG. 1, to illustrate the nesting of lower, shorter arm 5 within the longer arm 4.

The foregoing specification, and especially the description of the several drawings, is believed to present a clear understanding of the present hose coupling tool with respect to its configuration and the method by which it serves its intended function.

I claim as my invention:

1. A hose coupling handle which comprises, in combination:

a. a unitary body having a pair of elongated arms, one end of each being integral with a wider flat portion forming a band-like ring, the interior surface of which is knurled parallel to the central axis of said ring, said arms being (i) U-shaped in cross section, (ii) of unequal length and, (iii) sized to provide nesting of the shorter arm within the longer arm; and, b. means providing a wrapping force of said ring around said coupling, said means disposed (i) proximate to the junction of said arms with said wider flat portion and, (ii) substantially perpendicular to the horizontal plane containing the axis of said ring.

2. The hose coupling handle of claim 1 further characterized in that said wrapping force means is a screw which engages both of said arms.

* * * * *